United States Patent [19]

Hastings

[11] Patent Number: 4,523,459

[45] Date of Patent: Jun. 18, 1985

[54] METHOD FOR PERFORMING STEP RATE TESTS ON INJECTION WELLS

[75] Inventor: Joe R. Hastings, Midland, Tex.

[73] Assignee: Atlantic Richfield Company, Los Angeles, Calif.

[21] Appl. No.: 588,023

[22] Filed: Mar. 9, 1984

[51] Int. Cl.[3] ..... E21B 47/10; E21B 43/26

[52] U.S. Cl. ..... 73/155; 166/271

[58] Field of Search ..... 166/252, 266, 268, 269, 166/270, 271; 73/155

[56] References Cited

U.S. PATENT DOCUMENTS 4,192,182 3/1980 Sylvester ..... 166/271

4,374,544 2/1983 Westerman et al. ..... 166/252

4,442,895 4/1984 Lagus ..... 73/155

*Primary Examiner*—Howard A. Birmiel

*Attorney, Agent, or Firm*—Roderick W. MacDonald

[57] ABSTRACT

In a method for performing a step rate test on an injection well, a portable pumping unit is employed to increase the pressure on the injected water to a predetermined level in order to carry out the step rate test, and the predetermined pressure and flow rate are maintained and controlled by separating a portion of the pressurized water outflow from the portable pump from the main stream thereof, and the separated portion of pressurized water is returned to the water storage tank which feeds the input to the portable pump.

4 Claims, 2 Drawing Figures

METHOD FOR PERFORMING STEP RATE TESTS ON INJECTION WELLS

BACKGROUND OF THE INVENTION

Oil fields are often subjected to waterflooding as a secondary recovery technique wherein water is injected into the oil producing formation to force more oil out of the formation into producing wells than would otherwise be obtained by primary production techniques. When injecting water or other liquids into a geologic formation, it is usually desirable to keep the pressure of the injected water below the pressure at which the formation will fracture. This keeps the flow of injected water out into the formation as uniform as possible rather than preferentially flowing into and through articifically formed fractures or cracks and by-passing substantial parts of the formation.

Heretofore, a technique referred to as a step rate test or formation pressure parting test has been designed to be performed on injection wells for the purpose of determining the fracture pressure of a hydrocarbon-producing geologic formation into which water is pumped for secondary recovery purposes.

Step rate tests are known in the art and are fully and completely disclosed in U.S. Pat. No. 4,192,182, the disclosure of which is incorporated herein by reference. A step rate test requires the injection of water at predetermined ever increasing pressure steps so that the fracture pressure of the formation can be determined. A step rate test requires that at each predetermined pressure, the pressure and water flow rate associated therewith be maintained for a considerable period of time before moving to the next higher pressure and flow rate. In the above cited patent, a portable pumping unit is employed to accomplish the increased steps of pressure and flow rate in order to carry out a step rate test and preferably employs a positive displacement pump well known in the art.

BRIEF SUMMARY OF THE INVENTION

In this invention, a conventional step rate test is carried out employing a portable pumping unit. However, in accordance with this invention, it has been discovered that the maintenance of each predetermined pressure and flow rate during a step rate test can be difficult to maintain for the length of time necessary for such a test because the pumping unit can cause surges and ebbs in the pressurized injection water which cause variations in the pressure and flow rates of that water. Obviously, for best results it is desirable to keep such pressures and flow rates essentially constant at each predetermined pressure and flow rate level. These surges and ebbs are particularly pronounced when a reciprocal or positive displacement pump is employed in the portable pumping unit.

It has been discovered that such surging can be leveled out and an essentially constant pressure and flow rate maintained at a predetermined figure, and can be easily increased to the next higher predetermined figure with ease, if a portion of the pressurized water outflow from the main stream of the portable pump is continuously separated out therefrom and this separated portion returned upstream of the input to said portable pump. It has been found that this procedure allows an operator easily to obtain and maintain an essentially fixed injection pressure and flow rate for one level of the step rate test and then to increase the pressure and flow rate to the next higher predetermined figure and so on until all required steps of the step rate test have been accomplished without constant surging and relaxation of pressure and flow rates in the injected water during any given operating level.

Therefore, it is an object of this invention to provide a new and improved method for carrying out step rate tests.

It is another object of this invention to provide a new and improved method for controlling the pressure and flow rate of liquid being injected into a well for step rate test purposes.

Other aspects, objects and advantages of this invention will be apparent to those skilled in the art from this disclosure and the appended claims.

DETAILED DESCRIPTION OF THE INVENTION

Figure 1:
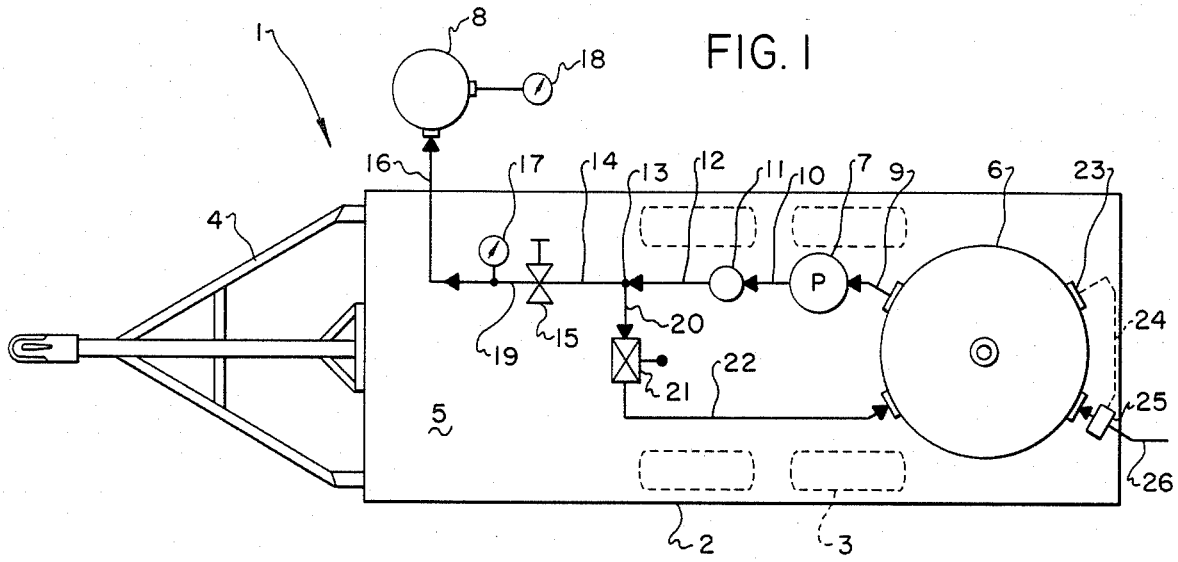
FIG. 1 is a top view of apparatus embodying a portable pumping unit employing the technique of this invention.

FIG. 1 shows a portable pumping unit 1 composed of a trailer bed 2 supported by tandem wheels 3 and carrying tongue means 4 by which pumping unit 1 may be towed by a vehicle. The upper or working surface 5 of bed 2 supports the equipment for carrying out the step rate test. The key elements of this equipment, although for sake of simplicity, not all elements are shown since they are well known to those skilled in the art, include a water storage tank 6 for receiving and holding water to be pressurized by portable pump 7 and then delivered to injection well 8 to be passed downwardly therein and injected into a subterranean hydrocarbon-producing geologic formation 32 in FIG. 2. Water from tank 6 passes through pipe 9 and supplies the input water for pump 7 which is to be pressurized by that pump. The pressurized water outflow from pump 7 passes through pipe 10 through a conventional dampner device 11 which is designed to take some of the surging and ebbing of pressure and flow rate out of the outflow in pipe 10. It has been found that conventional dampning devices currently on the market do not do an adequate job of smoothing out pump caused surges and that, therefore, the technique of this invention is necessary even though a dampning device 11 is employed. The output from dampning device 11 passed into pipe 12 and the main stream of the pressurized water outflow from pump 7 passes through pipe 12, pipe "T" 13, through pipe 14 which carries a conventional cut-off valve 15, through pipes 19 and 16, and into injection well 8. Cut-off valve 15 is used merely to stop the flow of water through pipe 14 into pipe 19 in a conventional manner for a number of reasons, one of which will be more fully disclosed hereinafter with respect to FIG. 2.

Pipe 14 has a flow rate meter 17 operably connected thereto, while injection well 8 has a water injection pressure meter 18 operably connected to the interior thereof. This way the flow rate and injection pressure of the water can be determined and monitored continuously for record keeping purposes and for purposes of carrying out the injection of pressurized water at various predetermined levels as required for carrying out a step rate test.

Pipe 20 is connected between the side leg of "T" 13 and a choke or flow line restrictor 21 whose output is connected by way of pipe 22 with the interior of water tank 6. Tank 6 has near the top thereof a conventional liquid level detector 23 which is connected by way of a pneumatic or electrical line 24 to valve 25 in pipe 26. Pipe 26 is connected to a source of water, such as that normally injected into injection well 8 for waterflood purposes when pumping unit 1 is not present. Pipe 26 supplies the water to fill tank 6 which in turn is used as input of feed water to pump 7. Liquid level detector 23 merely controls in a conventional manner the amount of water that valve 25 allows to pass from pipe 26 into tank 6 to keep tank 6 water full without overflowing.

Figure 2:
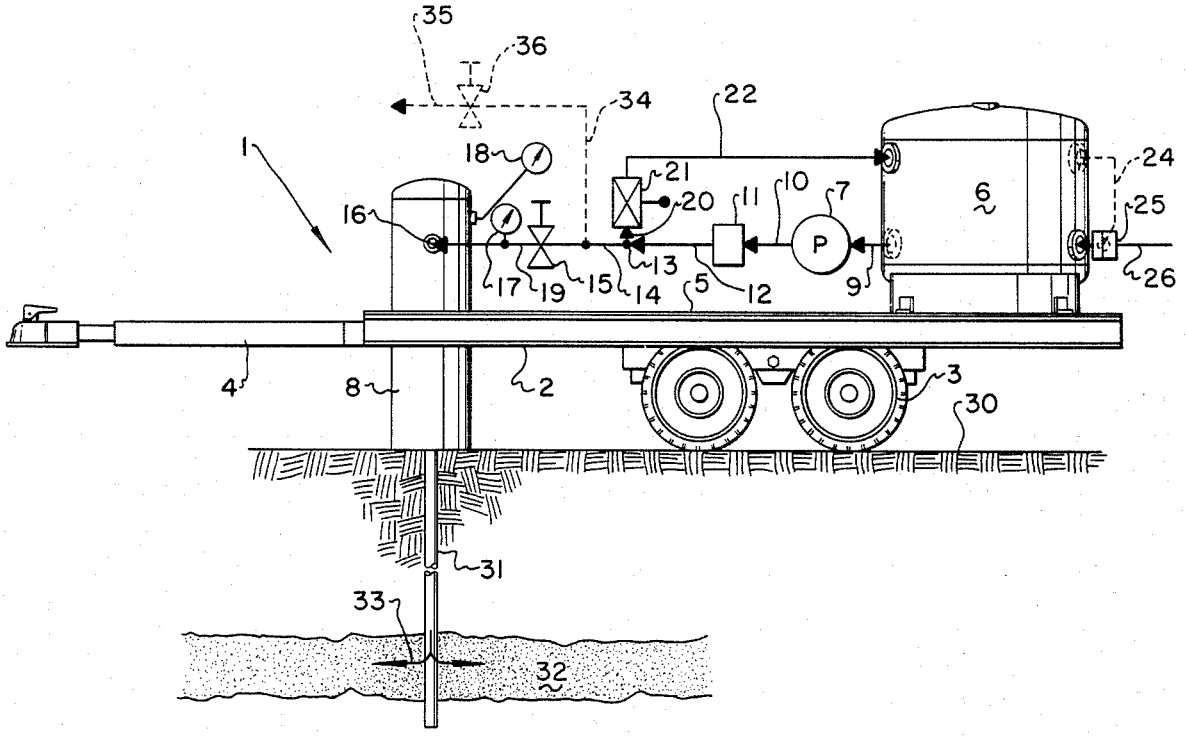
FIG. 2 is a side view of the apparatus of FIG. 1.

FIG. 2 shows the apparatus of FIG. 1 and in addition, shows wheel 3 resting on the surface of the earth 30. FIG. 2 also shows well tubing 31 extending downwardly from the interior of injection well 8 to hydrocarbon-producing geological formation 32 into which the pessurized water outflow from pump 7 is injected as shown by arrows 33.

Instead of having a single pipe system 14, 16 and 19 feeding pressurized injection water to well 8, more than one such pipe system can be employed, each pipe system having a different size interior diameter and, therefore, different water flow capacity. This way portable pumping unit 1 can be more adaptable to different pressurized injection water flow rate requirements of different wells. To this end one or more additional piping systems such as pipes 34 and 35 and cut-off valve 36 can also be carried by pumping unit 1. For example, should pipes 34 and 35 be of smaller interior diameter than pipes 16 and 19, and the particular well to be tested requires a smaller volume of water than is normally handled by larger pipes 16 and 19, then valve 15 can be closed, valve 36 opened, and the pressurized water passed to the injection well by way of pipe 35 rather than pipe 19. Of course, in this example, pipe 16 or another pipe would connect pipe 35 to injection well 8 in a manner similar to that already shown for pipe 16 and pipe 19 in FIG. 1. Additional pipe systems similar to 34 and 35 can be employed on the same pumping unit 1 but with just different sized pipe from either 34 and 35 or 16 and 19 can be employed, if desired.

In operation, lease water normally injected directly into well 8 is instead passed into pipe 26, allowed to fill tank 6, and used to keep tank 6 full while pump 7 draws water therefrom by way of pipe 9. Pump 7 is operated by a motor means (not shown) such as a diesel or gasoline engine. Pump 7 is operated at a rate which will cause the outflow of pressurized water from pump 7 in pipe 10 to be at a predetermined pressure level as measured by meter 18. The flow rate at any pressure level is measured at the same time by meter 17. Without pipe 20, choke 21, and pipe 22 being connected to separate a portion of the main stream of pressurized water in pipe 12 away therefrom, it has been found difficult to maintain an essentially constant flow rate in pipe 19 due to the operation of pump 7. This is particularly so when pump 7 is a reciprocating or positive displacement pump. However, in accordance with this invention, when choke 21 is at least partially open and continuously separating a portion of water out of pipe 12 for return to tank 6, the flow of water and pressure of water as measured by meters 17 and 18, respectively, is smoothed out so that essentially constant values for both pressure and flow rate can be maintained at each level of step rate testing. This way, a more accurate and reliable fracture pressure for formation 32 can be determined from the step rate test.

Choke 21 is a conventional liquid flow restricting means which, for example, can be a device in which a disc slides across the opening through which water from pipe 20 flows. Thus, there are an infinite number of settings between full open and full closed for choke 21 thereby allowing any desired setting of choke 21 to level out the flow rate registered on meter 17. Other types of chokes can be employed and still achieve the advantages of this invention so long as a portion, for example, up to 75% of the main stream of pressurized water can be continuously separated for return to tank 6 as necessary to smooth out the flow rate in pipe 19.

This invention otherwise employs a conventional step rate test wherein pump 7 is adjusted in its speed of operation to obtain a desired injection pressure and water is injected at that pressure for a time sufficient to establish a stabilized situation and the flow rate for that stabilized pressure is noted. Thereafter the pressure is increased in increments of a few hundred pounds per square inch by increasing the speed of operation of pump 7 and the new increased injection pressure is maintained until stabilization occurs with that flow rate also being noted. These steps are repeated a number of times at succeedingly higher pressures and flow rates, both below and above the suspected fracturing pressure for the formation. The pairs of pressures and flow rates are then plotted against one another in a conventional manner to determine where the slope of the straight line breaks which indicates the specific fracture pressure for that formation.

Reasonable variations and modifications are possible within the scope of this disclosure without departing from the spirit and scope of this invention.

I claim:

1. In a method for performing a step rate test on an injection well, wherein water from a water supply conduit is injected into said injection well to drive petroleum materials through a subterranean geologic formation toward a production well, and wherein said step rate test comprises connecting a portable pumping unit having a pump and water storage tank into said water supply conduit so that injection water from said supply conduit can be collected in said tank and the pressure of the injection water supplied to said injection well from said tank can be increased as desired by operation of said portable pump in order to carry out said step rate test, the improvement comprising collecting injection water from said supply conduit in said tank, withdrawing water from said tank through said portable pump to increase the pressure of said water to a first predetermined level, delivering the thus pressurized water outflow from said portable pump into said injection well for injection into said geologic formation while monitoring the flow rate and injection pressure of said pressurized water until the flow rate and injection pressure become essentially constant, maintaining said pressurized water at said first predetermined level while continuously separating a portion of said portable pump pressurized water outflow from the main stream thereof and returning said separated portion to said tank, repeating the above-described water pressurization and injection procedure at different predetermined pressure levels below and above the fracture pressure of said formation and determining the fracture pressure of said formation therefrom.

2. The method of claim 1 wherein said pressurized water flow rate is measured downstream of the point where said portion of pressurized water is separated from the main stream thereof for return to said tank.

3. The method of claim 2 wherein said portion of pressurized water separated from the main stream thereof is controlled as to the amount of water so separated by a choke means which is inifinitely variable between fully closed, where no water is separated, and fully open, where essentially the entire main stream is separated.

4. The method of claim 3 wherein said portable pump is a reciprocating pump.

* * * * *